United States Patent [19]

Grueneberg

[11] 4,109,755

[45] Aug. 29, 1978

[54] NOISE ATTENUATOR

[75] Inventor: Gary L. Grueneberg, Jerome, Mich.

[73] Assignee: Tenneco, Inc., Racine, Wis.

[21] Appl. No.: 729,435

[22] Filed: Oct. 4, 1976

[51] Int. Cl.[2] ..... F01N 7/14; F01N 7/16; F28D 7/00

[52] U.S. Cl. ..... 181/256; 181/266; 181/284; 181/294; 181/272; 181/282

[58] Field of Search ..... 181/282, 256, 283, 272, 181/284, 294; 165/52, 156

[56] References Cited

U.S. PATENT DOCUMENTS

| | | | |
|---|---|---|---|
| 3,280,903 | 10/1966 | Stoddard | 181/283 |
| 3,545,063 | 12/1976 | Mitchell | 165/156 |
| 3,554,275 | 1/1971 | Schade | 165/156 |

*Primary Examiner*—L. T. Hix
*Assistant Examiner*—Benjamin R. Fuller
*Attorney, Agent, or Firm*—Harness, Dickey & Pierce

[57] ABSTRACT

High temperature resisting cordage is wrapped around an exhaust gas muffler housing and covering with an outer wrap of metal to provide sound and thermal insulation for the muffler.

4 Claims, 2 Drawing Figures

NOISE ATTENUATOR

BRIEF SUMMARY OF THE INVENTION

It is the purpose of this invention to provide sound and heat insulation for an internal combustion engine exhaust gas muffler or the like.

The invention accomplishes this purpose by means of cordage this is laid in spaced sections on the outside of the muffler housing and held against the housing by an outer cover.

DETAILED DESCRIPTION OF THE INVENTION

Figure 1:
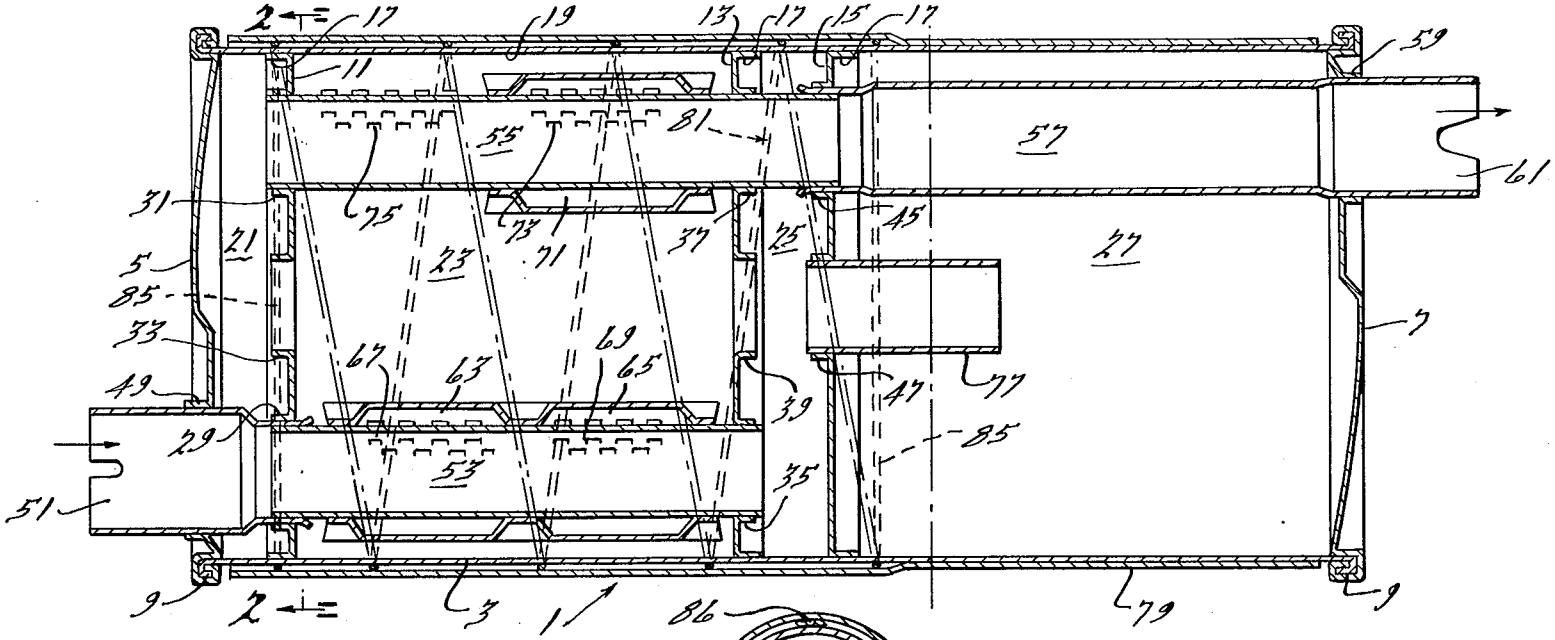
FIG. 1 is a longitudinal section through a typical exhaust gas muffler for a combustion engine and shows the invention applied to the housing thereof.
Figure 2:
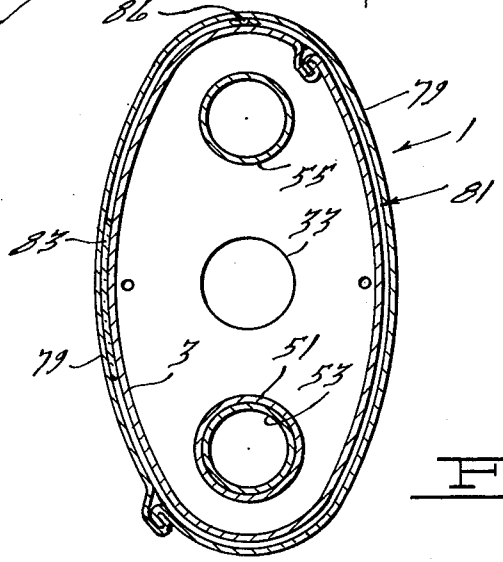
FIG. 2 is a cross section along the line 2—2 of FIG. 1.

A sound attenuating exhaust gas muffler 1 for a combustible fuel engine has an oval, tubular housing or shell 3 formed in accordance with any conventional or desired practice and closed in a conventional manner at opposite ends, respectively, by an inlet header or wall 5 and an outlet header or wall 7. The headers are shown as united with the ends of the housing 3 by means of gas-tight interlocked joints 9 as is common practice in the manufacture of mufflers. The housing 3 and headers 5 and 7 are made of metal, such as low carbon sheet steel.

Inside of the housing 3 are three longitudinally spaced, transversely extending partitions or walls 11, 13, and 15 with outer collars or annular flanges 17 that fit the inside surface 19 of the housing 3 and are spotwelded to it. They subdivide the interior of the housing into four separate chambers 21, 23, 25, and 27. Partitions 11 and 13 have longitudinally aligned openings defined, respectively, by collars or necks 29, 31, and 33 in partition 11, and 35, 37, and 39 in partition 13. Partitions 13 and 15 have longitudinally aligned openings defined, respectively, by collars or necks 39 and 37 in partition 13 and 45 and 47 in partition 15.

Header 5 has an opening defined by collar 49 in which is mounted and spotwelded an inlet bushing 51. The bushing extends through chamber 21, where it is reduced in diameter, and is supported in and spotwelded to collar 29 in partition 11. An inlet tube 53 has its upstream end supported inside of the downstream end of bushing 51 and its downstream end supported in and spotwelded to collar 35 in partition 13. A first outlet tube 55 has its upstream end supported in and spotwelded to collar 31 in partition 11 and extends through collar 37 in partition 13 and into the upstream end of a second outlet tube 57 which is supported in and spotwelded to collar 45 in partition 15. The second tube 57 extends through chamber 27 and is enlarged near its downstream end to be supported in and spotwelded to a collar 59 in the outlet header 7, the tube 57 having a portion extending downstream beyond the header 7 to serve as an outlet bushing 61.

Exhaust gas enters the muffler 1 through the inlet bushing 51 to flow into the inlet tube 53 and through it to cross chamber 25. It reverses direction to flow back through collar 39, chamber 23, and collar 33 into front cross chamber 21. It again reverses direction to enter the first outlet tube 55 and flows through it to the second outlet tube 57 and through it to leave the muffler through bushing section 61. While much sound energy is attenuated due to flow reversals and changes in the diameters of the flow paths just described, additional attenuation, particularly of higher frequencies takes place in the small volume spit chambers 63 and 65 which are mounted on inlet tube 53 and communicate through louver patches 67 and 69 with the gas in the tube and by the small volume spit chamber 71 on the first outlet tube which communicates with the gas through louver patch 73 in the outlet tube. An additional louver patch 75 in the outlet tube provides communication between the inside of the tube and the chamber 23 and serves to attenuate medium to high frequencies.

A short tuning tube 77 is supported in and spotwelded to collar 47 in partition 15 and extends into the chamber 27, the length and diameter of the tube and the volume of the chamber being interrelated by the Helmholtz principle to attenuate a selected, predetermined low frequency in the gas. It will be noted that the tube 77 serves as the only inlet and outlet for chamber 27 whereby there is relatively little actual gas flow into the chamber and consequently it operates at a temperature substantially lower than chambers 21, 23, and 25 through which all of the hot gas flows. On the other hand the chambers 21, 23, and 25 will be relatively hot because of the gas flow through them. It has been common practice to wrap a sheet or layer of asbestos around the portion of the shell 3 that encloses the "hot" chambers and hold the asbestos sheet in place by an outer wrap of relatively thin metal such as the outer layer 79. The asbestos serves as a heat and sound insulator. In accordance with the present invention, however, the asbestos sheet is eliminated and a single strand of high temperature withstanding yarn or cordage 81 is wound around the outside of the shell 3 over the length covered by the "hot" chambers. Standard "Refrasil" yarn and cordage available on the open market from HITCO of Gardena, California is satisfactory. Preferably, its nominal diameter is in the range of 0.030 to 0.053 inches. As seen in FIG. 1, one piece of the cordage is preferably helically wound around the "hot" section of the shell and adjacent helical turns 83 of the cordage need not be closely spaced and, in fact, are spaced quite far apart. Each end section 85 of the cord is preferably oval and normal to the muffler axis as shown. A knot 86 unites the ends of the cord to hold it tightly around the shell. The cordage is also held in place by the outer wrap 79 and in combination with the wrap 79 serves as a thermal and acoustic insulation substitute for the previously used sheet of asbestos and outer wrap. The cordage is particularly useful in applications where the primary function is sound absorption.

Modifications are within the scope of the invention. For example, the cordage can be in separate sections instead of one piece and the lengths and areas of the shell covered can vary, it being often useful to cover the full shell length. The size of the cordage and the spacing of the individual sections can vary but it is surprising that excellent results are obtained even though the spacing between adjacent turns is approximately ⅓ the major width of the shell. While the invention is shown applied to an ordinary exhaust gas sound attenuating muffler, it can also be applied to a catalytic converter for engine exhaust gases.

I claim:

1. An exhaust gas sound attenuating device such as a muffler for combustion engines comprising an elongated metal housing having an outer wall with an outer metal surface and also having an inlet and an outlet for gas, gas passage and sound attenuating means in the housing for the passage of gas inside said housing from said inlet to said outlet and attenuating sound associated therewith, said outer wall being in heat and sound transfer relationship with gas flowing through the housing, a plurality of spaced sections of high temperature withstanding cordage extending around and against the outer metal surface of the outer wall, and an elongated outer cover layer of metal wrapped around and against the cordage and housing and engaging the cordage to hold it against the outer metal surface, said outer cover layer being spaced from said outer surface by said cordage and acting with the cordage to provide heat and sound insulation for said outer wall.

2. The invention as set forth in claim 1 wherein said spaced sections of cordage are annular and extend circumferentially around the housing.

3. The invention as set forth in claim 2 wherein said cordage is in one piece and is helically wound around said housing to form said spaced annular sections.

4. The invention as set forth in claim 3 wherein each helical turn of the cordage is spaced from the next adjacent turn by a distance of approximately one-third the width of the muffler.

* * * * *